US007237734B2

(12) United States Patent
Miller

(10) Patent No.: US 7,237,734 B2
(45) Date of Patent: Jul. 3, 2007

(54) CRUSHING APPARATUS AND METHOD

(76) Inventor: Roy B. Miller, 6604 Brandywine Rd., Raleigh, NC (US) 27607-4847

( * ) Notice: Subject to any disclaimer, the term of this patent is extended or adjusted under 35 U.S.C. 154(b) by 206 days.

(21) Appl. No.: 11/037,653

(22) Filed: Jan. 18, 2005

(65) Prior Publication Data

US 2006/0157604 A1 Jul. 20, 2006

(51) Int. Cl.
*B02C 1/06* (2006.01)

(52) U.S. Cl. ..... 241/30; 241/266

(58) Field of Classification Search ..... 241/30, 241/27, 264–269

See application file for complete search history.

(56) References Cited

U.S. PATENT DOCUMENTS 3,131,878 A 5/1964 Bodine, Jr. ..... 241/262
4,026,481 A 5/1977 Bodine ..... 241/266
4,387,859 A 6/1983 Gurries ..... 241/262
4,406,412 A * 9/1983 Alexandersson ..... 241/36
4,927,089 A * 5/1990 Altmayer ..... 241/264

* cited by examiner

*Primary Examiner*—Mark Rosenbaum
(74) *Attorney, Agent, or Firm*—Womble Carlyle Sandridge & Rice, PLLC

(57) ABSTRACT

A crushing apparatus includes a substantially U-shaped spring member having a first beam portion having a first free end, a second beam portion having a second free end, and a fixed center portion. The first and second free ends are in opposed, spaced relation with each other. A first crushing mass is positioned on the first free end, and a second crushing mass is positioned on the second free end of the spring member. An exciter is configured to excite the first and second beam portions at about a common first modal frequency. When so excited, the first and second crushing masses reciprocally converge and diverge such that material positioned between the crushing masses is at least partially crushed therebetween.

29 Claims, 7 Drawing Sheets

CRUSHING APPARATUS AND METHOD

FIELD OF THE INVENTION

The invention relates to devices and methods for comminuting substantially solid materials such as rock, and more particularly relates to an energy efficient device and method that utilize resonant vibrational energy to comminute such materials.

BACKGROUND

Quarries and aggregate suppliers utilize various types of rock crushing equipment to fragment or comminute rocks into various desired sizes or grades of aggregate. Such equipment generally is classified as primary, secondary, or tertiary crushing equipment. Primary crushers include large devices that are sized to receive large rocks and boulders up to about 60 inches in diameter, and are capable of comminuting such rocks or boulders into fragments to less than about 4 inches in diameter. Smaller secondary and tertiary crushers are used to further comminute such reduced fragments to a desired final size or grade.

One common type of rock crusher is a jaw crusher. Jaw crushers typically include a stationary mandrel and an opposed, pivoting jaw that reciprocates between an open position and a crushing position. Rock is fed between the stationary mandrel and pivoting jaw, where the rock is compressed and crushed into smaller fragments. Jaw crushers commonly are used as both primary and secondary crushers.

Gyratory cone crushers typically include a stationary bowl or cone having substantially upright sides and an open top. A central gyrating mandrel within the bowl forms alternating open and closed gaps between the mandrel and the sides of the bowl as the mandrel eccentrically gyrates within the bowl. Rock that is introduced into the open top of the bowl is crushed between the upright sides and the gyrating mandrel as the mandrel reciprocally approaches the upright sides. Like jaw crushers, gyratory cone crushers commonly are used as either primary or secondary crushers.

Roll crushers primarily are used as secondary or tertiary crushers due to their characteristically low reduction ratios. Roll crushers include a plurality of spaced and opposed rolls. Opposed rolls rotate in opposite directions and form a crushing region between the rolls. The rolls may have substantially smooth outer surfaces, or may include cooperating spaced teeth or picks.

Unlike the compressive crushing action of jaw crushers, gyratory cone crushers, and roll crushers, impact crushers crush rock by imparting sudden impact forces to the rock. Horizontal shaft impact crushers typically include one or more rotating horizontal shafts having a plurality of outwardly extending arms or paddles. As the horizontal shafts are rotated at high speeds, rock is fed to the paddles and shattered by the rock's impact with the rapidly moving paddles. Horizontal shaft impact crushers commonly are used as primary, secondary, or tertiary crushers. Because of the high impact forces that are characteristic of such crushers, these devices require substantial periodic maintenance. Vertical shaft impact crushers include a central spindle or drum that is rotated at high speeds. As rock is fed to the center of the rotating spindle, the rock is centrifugally cast at high velocity against a surrounding ring of anvils, where the rock is shattered into fragments. Vertical shaft impact crushers primarily are used as secondary or tertiary crushers.

All of the traditional types of rock crushers described above include electric motors to drive the various types of crushing mechanisms. Due to the large amount of energy required to crush or shatter rock, such electric motors necessarily consume substantial amounts of electric power during operation. Accordingly, the traditional forms of rock crushing equipment described above are not energy efficient. In other words, such devices use brute force to break rock, and require large energy inputs to attain such substantial crushing forces.

Others have attempted to improve the energy efficiency of rock crushing equipment by harnessing the amplified vibratory motion and vibrational energy of various resonant spring-mass systems. For example, U.S. Pat. No. 4,387,859 to Gurries describes a resonantly-powered rock crusher that includes two opposed, elongated pendulous beams having cooperating crushing jaws located at their lower ends. The upper ends of the beams are pinned to a frame such that the beams swing on the frame in a common plane. Oscillatory drivers at the upper, pinned ends of the beams synchronously drive the beams 180 degrees out of phase with each other such that the crushing jaws converge toward and diverge away from each other. The system is driven at a frequency that is slightly below the resonant frequency of the pendulous beams. Unfortunately, such a device has several shortcomings. First, the massive pivotally supported beams described and shown in this patent characteristically must have high natural frequencies and low amplitudes of vibration. Such low amplitudes limit the maximum separation of the crushing jaws, and thereby limit the size of rock that can be introduced between the jaws for crushing. In addition, the oscillatory drivers used to actuate the resonant system necessarily induce forces in the beams that are often misaligned with the beams' swinging motions. Such forces necessarily induce undesirable stresses in the beams, bearings, and frame. Furthermore, only a small fraction of the electric energy supplied to the oscillatory drivers is effectively transferred to the beams for crushing rocks. Accordingly, such a system is less energy efficient than desired.

U.S. Pat. No. 4,026,481 to Bodine describes another rock crushing device that includes two opposed jaws mounted on a pair of opposed horizontal bars. The bars are substantially simply supported at spaced intervals, and are independently driven such that the bars synchronously resonate in a lateral mode. A resonant frequency excitation sets up a standing wave in the bars. The jaws are located on the bars' vibrational antinodes (maximum deflection), and the bars are supported on their vibrational nodes (minimum deflection). This device also appears to include several shortcomings. The device uses independent rotating eccentric weights to excite the bars to resonance. Though the rotating weights induce useful horizontal excitation forces that are in plane with the desired standing waves of the bars, the rotating weights also induce cyclic out-of-plane forces that act to deflect the longitudinal beams in a vertical direction. Because such out-of-plane forces place substantial loads on the device's bars, bearings, and supports, and contribute nothing to the breaking of rock, these forces are both stressful and wasteful. In addition, because the bars must endure substantial deflections in order to provide sufficient spacing between the opposed jaws to receive rock materials for crushing, the bars also are subjected to substantial stresses during operation. Furthermore, the separate independent rotating drivers must be closely synchronized in rotation to cause the bars to vibrate in harmony with one another.

Another rock crushing device that attempts to harness resonant vibrational energy to crush rock is described in U.S. Pat. No. 3,131,878 to Bodine. In one described embodiment, the device includes a stationary anvil or fixed jaw, and a movable jaw. The movable jaw is mounted on the end of an elongated shaft. A vibration generator produces a resonant, longitudinal standing wave in the shaft, thereby causing the movable jaw to cyclically approach and retreat from the fixed jaw. In another described embodiment, the "fixed" jaw is similarly driven at a longitudinal resonant frequency 180 degrees out of phase with the movable jaw. Because the device operates at a high frequency, the resulting jaw displacement must be relatively small. In addition, the device appears to be substantially incapable of imparting substantial impact forces to rock. Accordingly, the device appears incapable of fracturing large rocks, and appears unsuitable for use as a primary crusher.

The conventional crushing devices typically use one or more basic techniques or methods to fracture material such as rocks. Impact crushers, for example, apply high acceleration forces to rock to shatter the rock into smaller fragments. Jaw, cone, gyratory, and roll crushers, on the other hand, use cleavage to squeeze rock at high pressures to fracture the rock. Such cleavage machines also typically cause localized cleavage failure or abrasion that produces fine unwanted particles or fines.

Accordingly, there is a need for an improved crushing device and method that is more reliable and more efficient than known crushing machines. In particular, there is a need for an energy efficient crushing device and method that utilizes resonant vibrational energy to efficiently convert energy inputs into substantial impact and compression forces that are capable of effectively fracturing large rocks. Such a device should be exceptionally durable, and require minimal maintenance. In particular, the device should minimize the use of bearings, gearboxes, sheaves, belts, and other moving parts and mechanical speed reducing equipment. In addition, such a device should operate at an optimum frequency and at an optimum amplitude of vibration to permit the device to effectively fragment both large and smaller rocks by imparting substantial impact and compression forces to the rock. Such a device should apply multiple impacts to crush a rock to provide superior size control and minimize the quantity of fines produced during crushing. In addition, there is a need for an apparatus and method that crushes rock to produce aggregate having a desired size and grade without the need for multiple passes through various forms of crushing equipment. The device and method should apply an optimal combination of shatter and cleavage crushing forces to produce a desired grade of aggregate with a minimum amount of waste or fines.

SUMMARY OF THE INVENTION

The invention includes a crushing apparatus includes a substantially U-shaped spring member having a first beam portion having a first free end, a second beam portion having a second free end, and a fixed center portion. The first and second free ends are in opposed, spaced relation with each other. A first crushing mass is positioned on the first free end, and a second crushing mass is positioned on the second free end of the spring member. An exciter or power module is configured to excite the first and second beam portions at about a common first modal frequency. When so excited, the first and second crushing masses reciprocally converge toward and diverge away from each other.

The invention also includes an apparatus for crushing a material that includes a first elongated beam having a first fixed end and a first substantially free end. The apparatus further includes a second elongated beam having a second fixed end and a second substantially free end. A first crushing member is on the first substantially free end of the first beam, and a second crushing member is on the second substantially free end of the second beam. The second crushing member is positioned in opposed spaced relation with the first crushing member. At least one beam exciter excites the first beam and the second beam in a substantially common plane in a cantilever beam mode of vibration at about a common modal frequency of the first and second beams, thereby causing the first and second crushing members to reciprocally converge and diverge from one another.

In addition, the invention includes an apparatus for fragmenting a substantially brittle material that includes a first cantilevered beam having a first fixed end and a first free end. A first crushing head is on the first beam proximate to the first free end. That apparatus further includes a second crushing head, and means for exciting the first cantilevered beam at about a first modal frequency of the first cantilevered beam. When so excited, the first crushing head reciprocally converges toward and diverges away from the second crushing head, whereby a brittle material positioned between the first and second crushing heads is at least partially fragmented.

The invention further includes a method of crushing a substantially solid material. The method includes providing a first spring-mass system comprising a first spring and a first crushing mass, the first spring-mass system having a first modal frequency of vibration and a first vibration node. The method further includes providing a second spring-mass system comprising a second spring and a second crushing mass, wherein the second spring-mass system has a first modal frequency that is substantially equal to the first modal frequency of the first spring-mass system. The second spring-mass system has a second vibration node that is substantially coincident with the first vibration node, and is harmonically coupled to the first spring-mass system. The method also includes exciting at least one of the first and second spring-mass systems such that the first and second spring mass systems are caused to vibrate about 180 degrees out of phase with each other at a frequency that is substantially equal to the first modal frequency, thereby causing the first and second crushing masses to reciprocally converge and diverge. The method further includes introducing a solid material between the reciprocally converging and diverging first and second crushing masses, thereby causing at least a portion of the solid material to be at least partially fragmented therebetween.

These and other aspects of the invention are described in the following detailed description and drawings.

DETAILED DESCRIPTION

Figure 1:
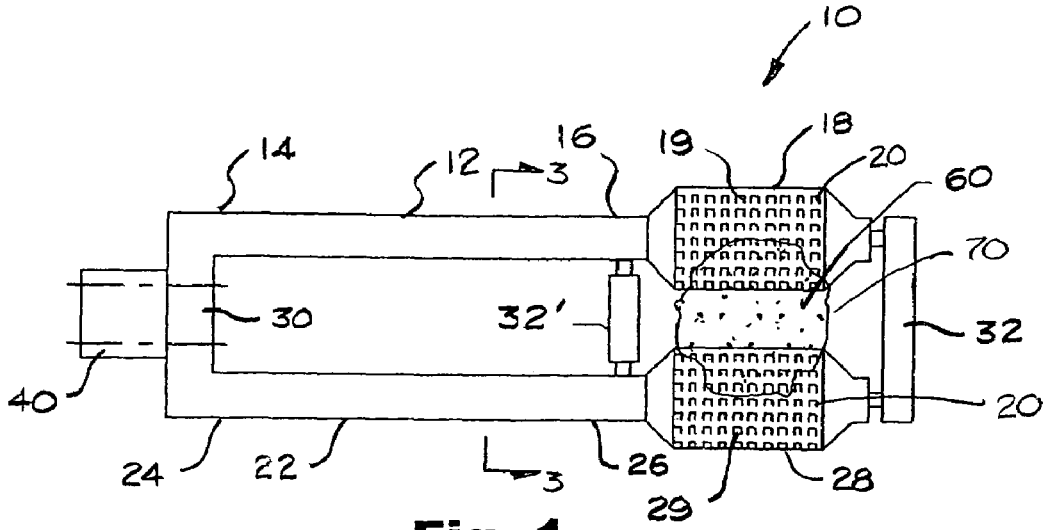
FIG. 1 is a plan view of one embodiment of a crushing device according to the invention.
Figure 2:
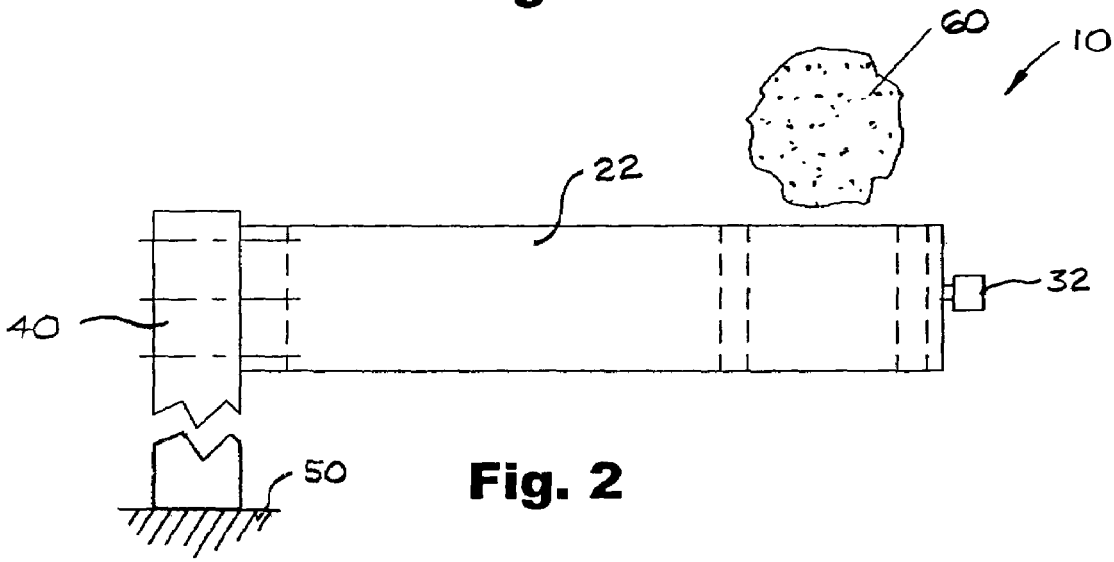
FIG. 2 is a side elevation view of the crushing device of FIG. 1.
Figure 3:
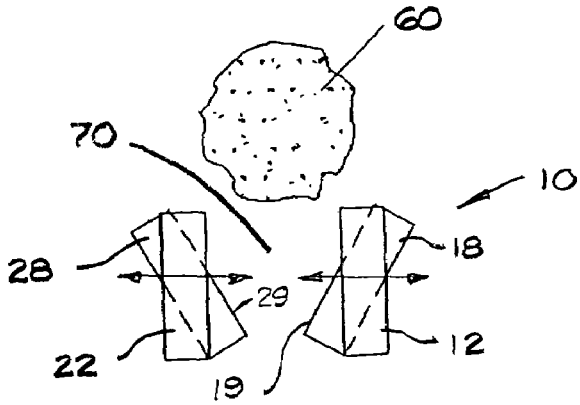
FIG. 3 is cross sectional view of the crushing device of FIGS. 1 and 2 taken along line 3—3 in FIG. 1.

One embodiment of a rock crushing device 10 according to the invention is shown in FIGS. 1–3. As shown in FIG. 1, the device 10 includes a first elongated beam 12 having a fixed end 14 and a free end 16. The term "fixed", as used herein, means substantially restrained against both displacement and rotation. The term "free", as used herein, means substantially unrestrained against displacement and rotation. The device 10 also includes a second elongated beam 22 having a fixed end 24 and a free end 26. The first and second cantilevered beams 12, 22 preferably are mirror images of each other, such that the beams 12, 22 have substantially equal modal frequencies in at least a cantilever beam mode of vibration. The first and second beams are spaced apart a desired distance as shown in FIG. 1. The fixed ends 14, 24 of the cantilevered beams 12, 22 may be joined or coupled together by a yoke or coupling portion 30. As shown in FIG. 2, the fixed ends 14, 24 are attached to a foundation 50 by a substantially rigid support or anchor 40. In this embodiment 10, the cantilevered first and second beams 12, 22 are substantially horizontal as shown in FIG. 2, and are substantially parallel as shown in FIG. 1.

A first hammer or crushing member 18 is attached to the free end 16 of the first beam 12, and a second hammer or crushing member 28 is attached to the free end 26 of the second beam 22. The first and second crushing members 18, 28 are spaced apart to form a crushing region or crushing zone 70 therebetween. The crushing members 18, 28 may include opposed inclined crushing surfaces 19, 29 as shown in FIG. 3, wherein the horizontal spacing between the crushing surfaces 19, 29 is widest near their top edges. The crushing surfaces 19, 29 preferably are constructed of a hard, tough and durable material, such as a strong and non-brittle metal, and may include a plurality of raised teeth or dimples 20 thereon as shown in FIG. 1.

Referring to FIG. 1, a first exciter or power module 32 is provided between the crushing members 18, 28. The first exciter 32 may be any device capable of exciting the opposed beams 12, 22 to vibrate such that the opposed crushing members 18, 28 reciprocally approach each other and separate or diverge from each other. For example, the exciter 32 may be a reciprocating single-acting or double-acting piston driven device such as a hydraulic or pneumatic cylinder configured to lengthen and contract, thereby urging the crushing members 18, 28 apart and/or toward each other. Alternatively, the exciter 32 may be an electrical solenoid, a linear motor, or any other type of suitable linear actuator capable of imparting a forceful excitation to the system. Furthermore, the exciter 32 may be a mechanical driver such as a suitable mechanical linkage or an eccentric rotating cam.

The crusher 10 may also include a second exciter 32' positioned between the free ends 16, 26 of the beams 12, 22 as shown in FIG. 1. The second exciter 32' may be provided in addition to or in lieu of the first exciter 32. Like the first exciter 32, the second exciter may be any device capable of exciting the opposed beams 12, 22 to vibrate in a manner such that the opposed crushing members 18, 28 thereafter reciprocally converge and diverge.

In operation, the exciter 32 and/or 32' is actuated and excites the opposed cantilevered beams 12, 22 to vibrate in a substantially common plane in a beam mode of vibration at about a common modal frequency of the first and second cantilevered beams 12, 22. The resulting displacements of the free ends 16, 26 of the first and second beams 12, 22 are at or about 180 degrees out of phase, such that the first and second crushing members 18, 28 reciprocally converge toward each other and diverge away from each other as the beams 12, 22 vibrate in a substantially common plane as indicated by the arrows in FIG. 3. The yoke or coupling portion 30 that connects the opposed beams 12, 22 at their fixed ends 14, 24 harmonically couples the beams together. Accordingly, the opposed modal vibrations of the two beams 12, 22 are passively synchronized without the need for active mechanical intervention or control. The established pattern of opposed vibrations between the beams 12, 22 is similar to the synchronous opposed vibrations of the prongs of a tuning fork. Because the exciter 32 or 32' excites the beams 12, 22 at or near a common natural frequency, the vibrational displacements of the crushing members 18, 28 on the free ends of the beams 16, 26 are substantial.

As the beams 12, 22 vibrate, the crushing surfaces 19, 29 of the inclined crushing members 18, 28 reciprocally converge and diverge. One or more rocks or bodies 60 are deposited into the upper portion of the crushing zone 70 between the crushing surfaces 19, 29 to be crushed or comminuted. As the beams 12, 22 and crushing members 18, 28 converge, the rock 60 is impacted by and at least partially compressed between the converging crushing surfaces 19, 29, thereby fracturing the rock into a plurality of fragments. As the crushing surfaces 19, 29 recoil and separate from each other, the rock fragments drop lower in the crushing region 70, and again are impacted and compressed between the crushing surfaces 19, 29 as the crushing members 18, 28 reconverge. The rock fragments are thereby crushed into progressively smaller pieces as they move downwardly in the crushing region 70. As the process continues, crushed rock aggregate eventually falls from the crushing zone 70 to a collection area beneath the crushing members 18, 28. In operation, a plurality of rocks 60 may be continuously fed through the crushing zone 70 to produce aggregate.

Figure 4:
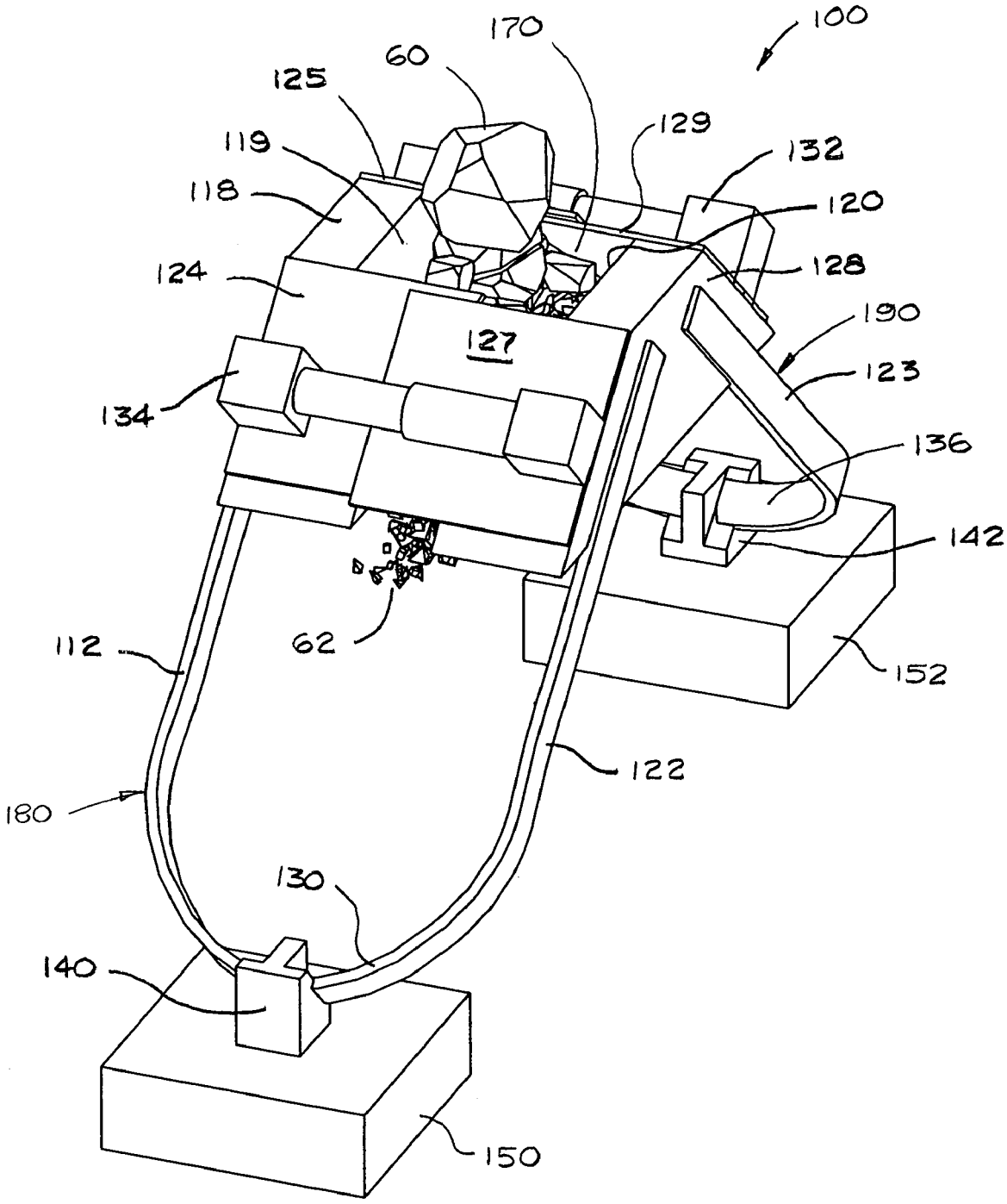
FIG. 4 is a perspective view of a second embodiment of a crushing device according to the invention.
Figure 5:
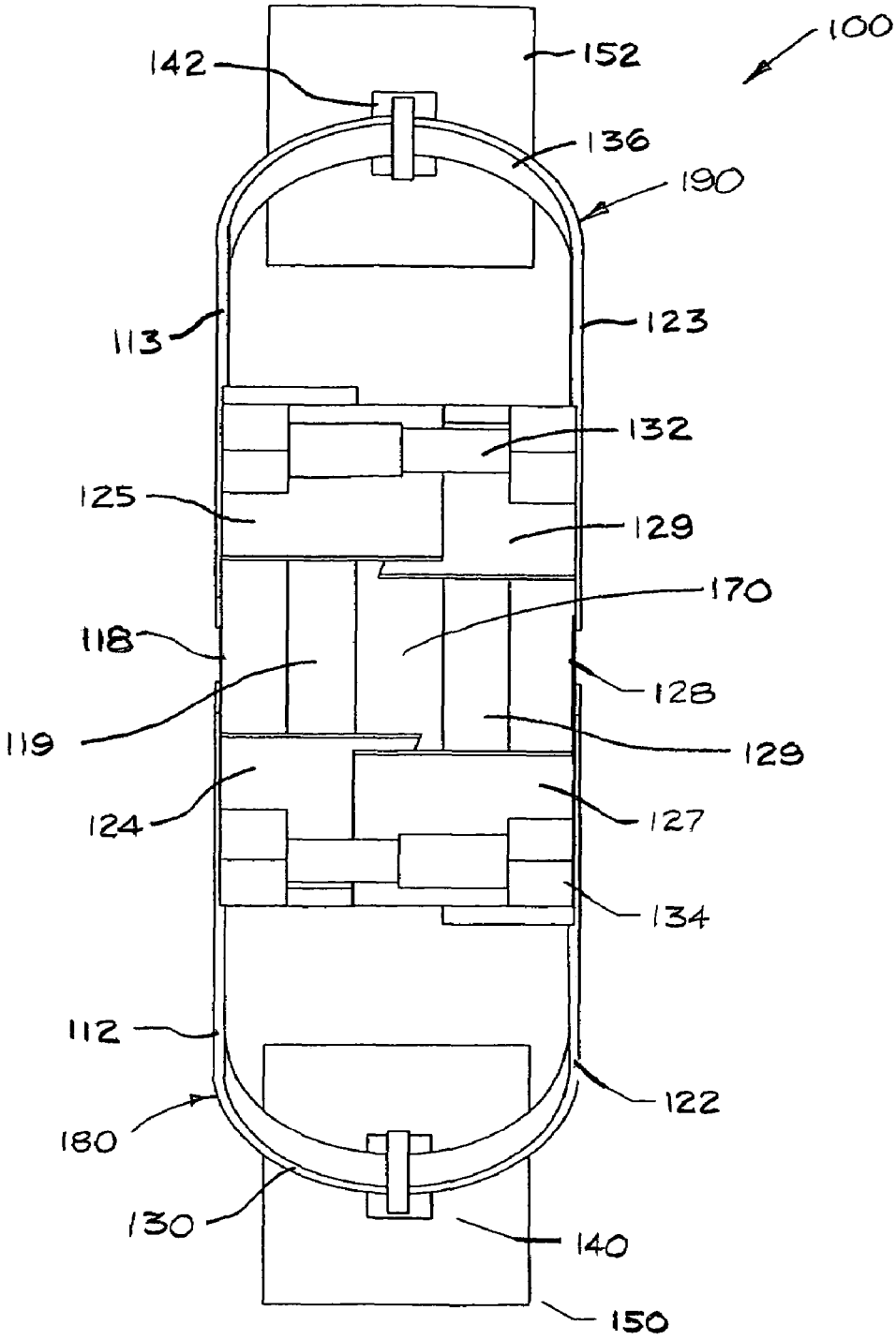
FIG. 5 is a plan view showing the top of the crushing device shown in FIG. 4.
Figure 6:
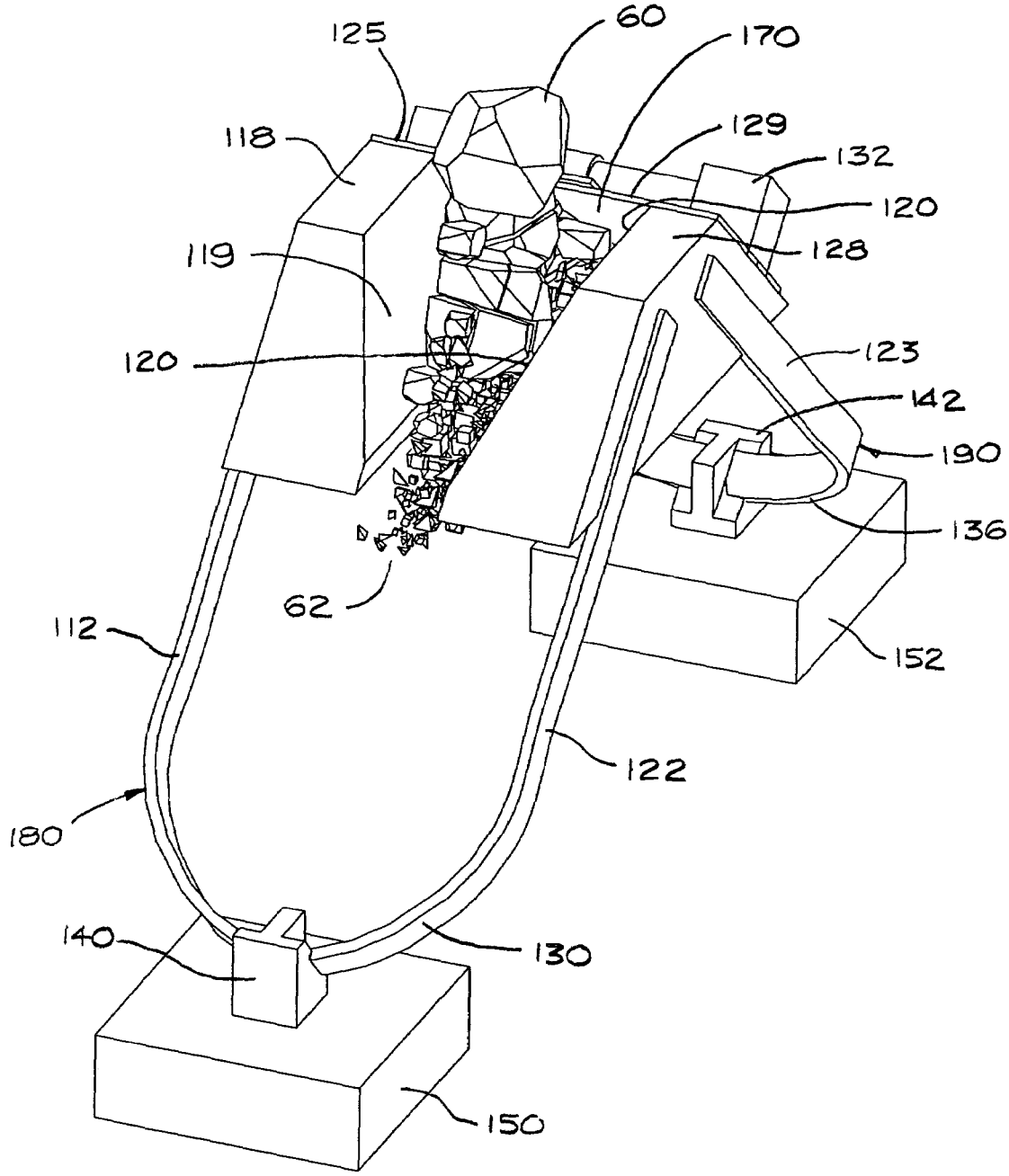
FIG. 6 is a perspective view of the rock crushing device of FIGS. 4 and 5 with portions removed to show the crushing region between the opposed hammers.

Another embodiment 100 of a crushing device according to the invention is shown in FIGS. 4–7. In this embodiment, the crushing device 100 includes two opposed U-shaped spring members 180, 190. In this embodiment 100, the opposed spring members 180, 190 are inclined towards each other at about a 45-degree angle as shown in FIGS. 4 and 6. The spring members 180, 190 also may be oriented substantially horizontal or substantially vertical, for example. The first U-shaped spring member 180 includes an elongated first beam portion 112 and an opposed elongated second beam portion 122. The fixed ends of the first and second beam portions 112, 122 are physically and harmonically coupled by an arcuate coupling portion 130. The first spring member 180 is bilaterally symmetrical. Accordingly, the first and second elongated beam portions 112 and 122 have substantially equal modal frequencies of vibration within the plane of the spring member 180. As shown in FIG. 5, the second U-shaped spring member 190 is a mirror image of the first U-shaped spring member, and includes an elongated third beam portion 113, and an opposed elongated fourth beam portion 123. The fixed ends of the third and fourth beam portions 113, 123 are physically and harmonically coupled by an arcuate coupling portion 136. The second spring member 190 also is bilaterally symmetrical. Accordingly, the third and fourth elongated beam portions 113 and 123 have modal frequencies of vibration within the plane of the second spring member 190 that are substantially equal to each other, and that also are substantially equal to the modal frequencies of the first and second beam portions 112, 122.

The opposed U-shaped spring members 190, 190 are rigidly supported at the centers of their coupling portions 130, 136 by anchors 140 and 142, respectively. The anchors 140 and 142 are fixedly mounted to one or more rigid foundations 150, 152. A first crushing member 118 is disposed between the free ends of beam portions 112 and 113, and a second crushing member 128 is disposed between the free ends of beam portions 122 and 123. Accordingly, the crushing members 118, 128 are in opposed, spaced relation with each other. The crushing members 118, 128 are mirror images of each other, and have substantially equivalent masses.

A crushing zone 170 is formed between the opposed inclined crushing surfaces 119, 129 of the crushing members 118, 128. The crushing surfaces 119, 129 may be constructed of any suitably hard, tough, and durable material, and may include teeth, dimples, or other surface configurations as desired. A first pair of cooperating side plates 124, 127 is provided on one side of the crushing zone 170, and a second pair of cooperating side plates is provided on an opposite side of the crushing zone 170. The pairs of side plates 124/127, 125/129 are arranged such that the plates in each pair can at least partially slide past each other as the crushing members 118, 128 converge and diverge during operation of the device 100. The pairs of cooperating side plates 124/127, 125/129 act to contain rocks or other objects 60 within the crushing zone 170 as the objects 60 pass through and are fragmented between the crushing members 118, 128.

As shown in FIGS. 4 and 5, one or more exciters 132, 134 are provided between the opposed crushing members 118, 128. The exciters 132, 134 may be any suitable excitation device capable of exciting opposed sets of beams 112/113, 113/123 to vibrate such that the opposed crushing members 118, 128 thereafter reciprocally converge and diverge. For example, the exciters 132, 134 may be a reciprocating single-acting or double-acting hydraulic or pneumatic cylinders configured to lengthen and contract, thereby urging the crushing members 118, 128 apart and/or toward each other. Alternatively, the exciters 132, 134 may be electrical solenoids or linear motors, for example, or any other type of suitable linear actuator. Furthermore, the exciters 132, 134 may include a suitable mechanical linkage or rotating cam, for example. Because the exciters 132, 134 excite the beam portions 112, 113, 122, 123 at or near a common natural frequency, the resonant vibrational displacements of the crushing members 118,128 on the free ends of the beams are substantial.

Figure 7:
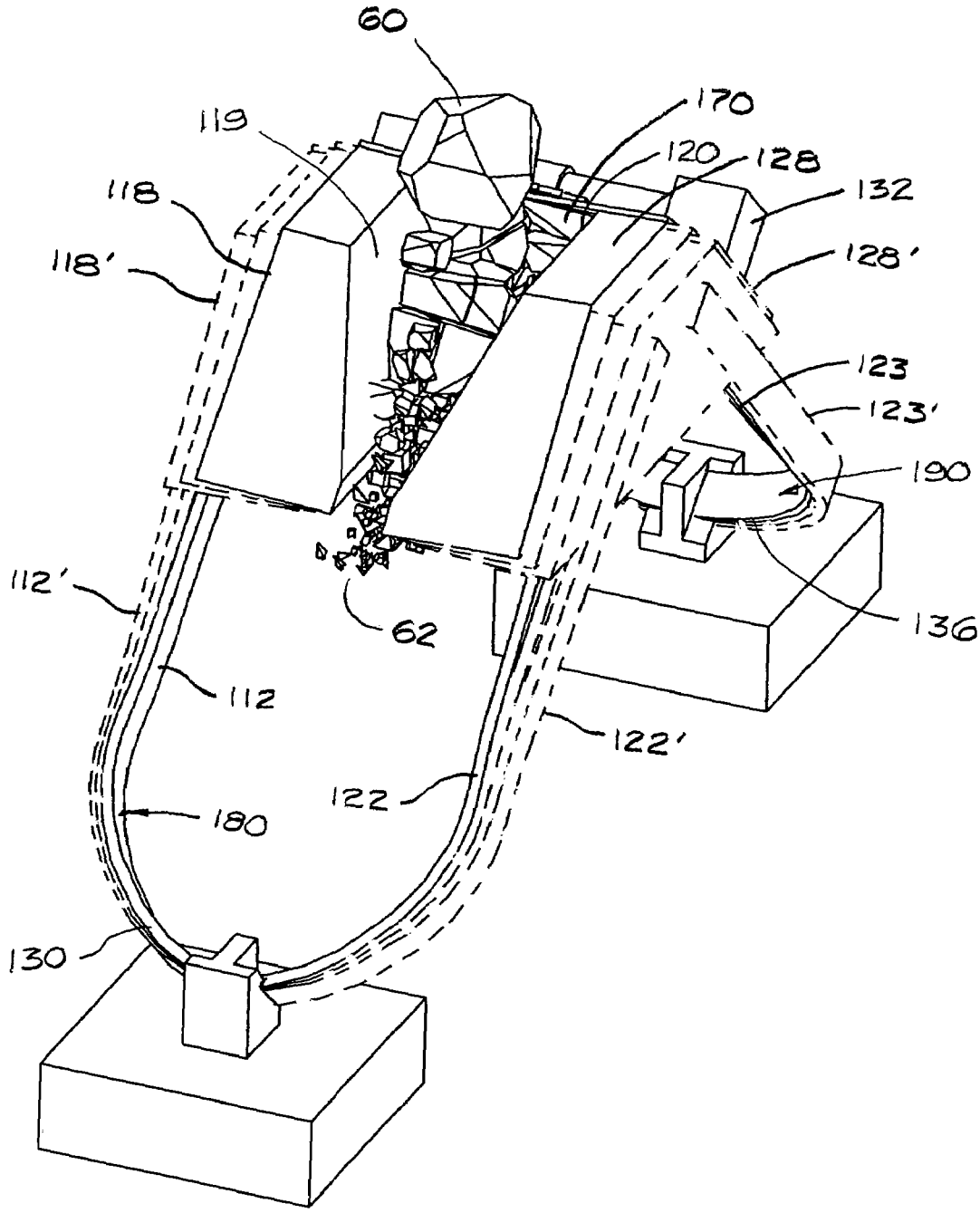
FIG. 7 is a perspective view of the rock crushing device shown in FIGS. 4–6 showing the vibrational displacement of the opposed beams and hammers.

Operation of the crushing device 100 is shown in FIGS. 6 and 7. In these figures, the exciter 134 and side plates 124, 127 are removed to better show the crushing zone between the crushing members 118, 128. As shown in FIG. 6, the crushing surfaces 119, 120 are sufficiently spaced apart to permit large rocks 60 or other large objects to enter the top of the crushing zone 170. The large rocks/objects 60 may be introduced into the crushing zone 170 between the opposed crushing members 118, 128 by any suitable means, such as a feed hopper, a feed conveyor, a power shovel, a crane, or the like.

To crush or comminute the rocks 60 into aggregate 62, the exciters 132, 134 are actuated to set up a resonant or near-resonant vibration in the opposed beam portions 112/122, 113/123 of the spring members 180, 190. As shown in FIG. 7, the beam portions 112/113, 122/123 and crushing members 118, 128 oscillate between inwardmost positions (indicated in solid lines), and outermost positions (indicated in dashed lines). Since beam portions 112 and 122 are harmonically coupled to each other by coupling portion 130, and beam portions 113 and 123 are harmonically coupled to each other by coupling portion 136, once the beam portions are excited at or near a first modal frequency by the exciters 132, 134, the crushing members reciprocally vibrate 180 degrees out phase from each other like the prongs of a tuning fork. As rock 60 is introduced between the reciprocally converging crushing surfaces 119, 120 of the crushing members 118, 128, the rock 60 is subjected to substantial impact and crushing forces, thereby fracturing the rock 60 into a plurality of fragments. As the crushing surfaces 119, 120 recoil and separate from each other, the rock fragments drop lower in the crushing region 170, and again are impacted and compressed between the converging crushing surfaces 119, 120 as the crushing members 118, 128 reconverge. The rock fragments are thereby crushed into progressively smaller pieces as they move downwardly in the crushing region 170. As the process continues, crushed rock aggregate 62 eventually falls from the crushing zone 170 to a collection area beneath the crushing members 118, 128. In operation, a plurality of rocks 60 may be continuously fed through the crushing zone 170 to produce aggregate 62.

Figure 8:
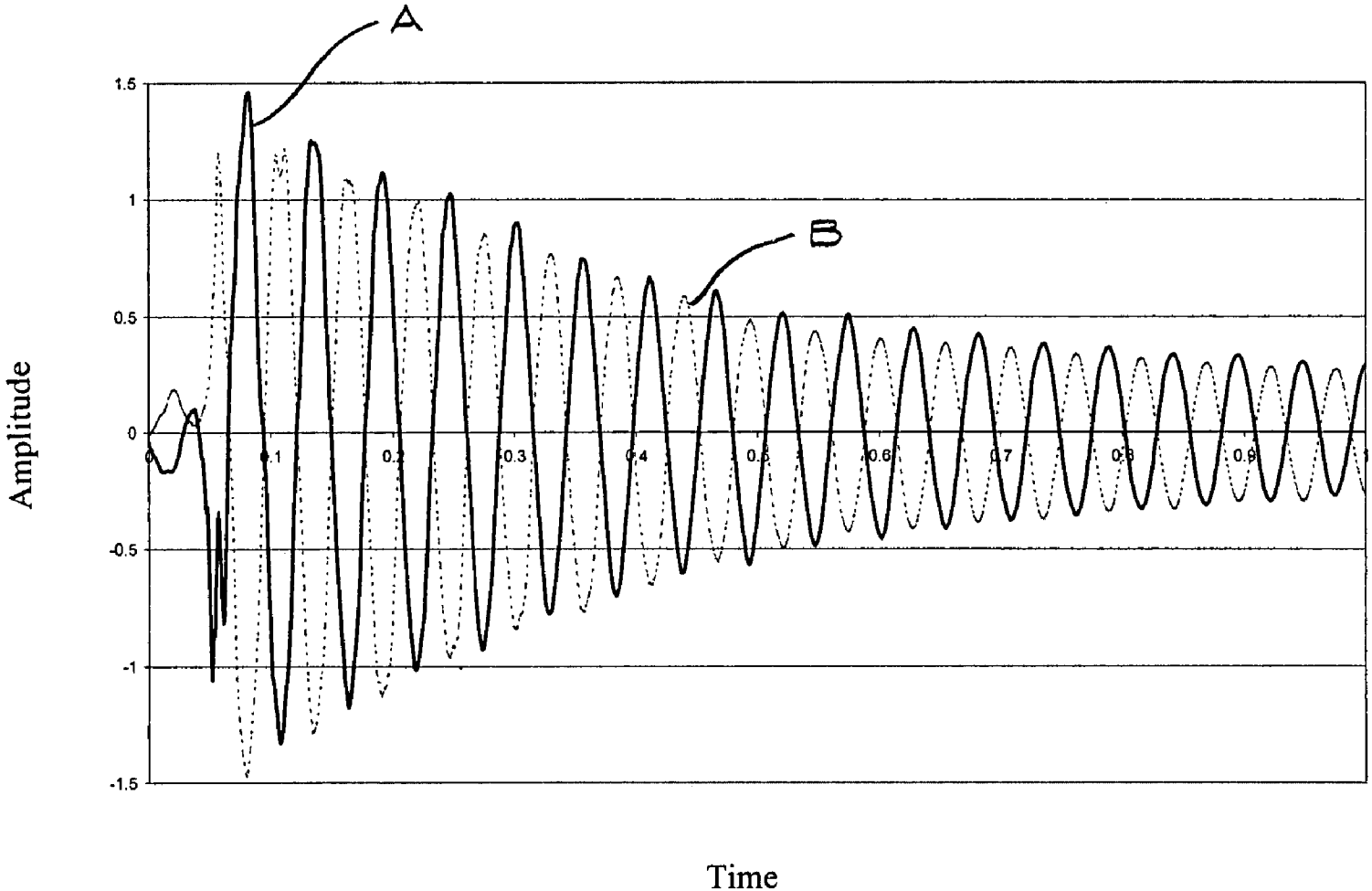
FIG. 8 is a graph showing the relative displacements of the first and second opposed hammers over time for the crushing device shown in FIGS. 5–7 when the opposed hammers and supporting beams are simultaneously excited by a single induced initial displacement.
Figure 9:
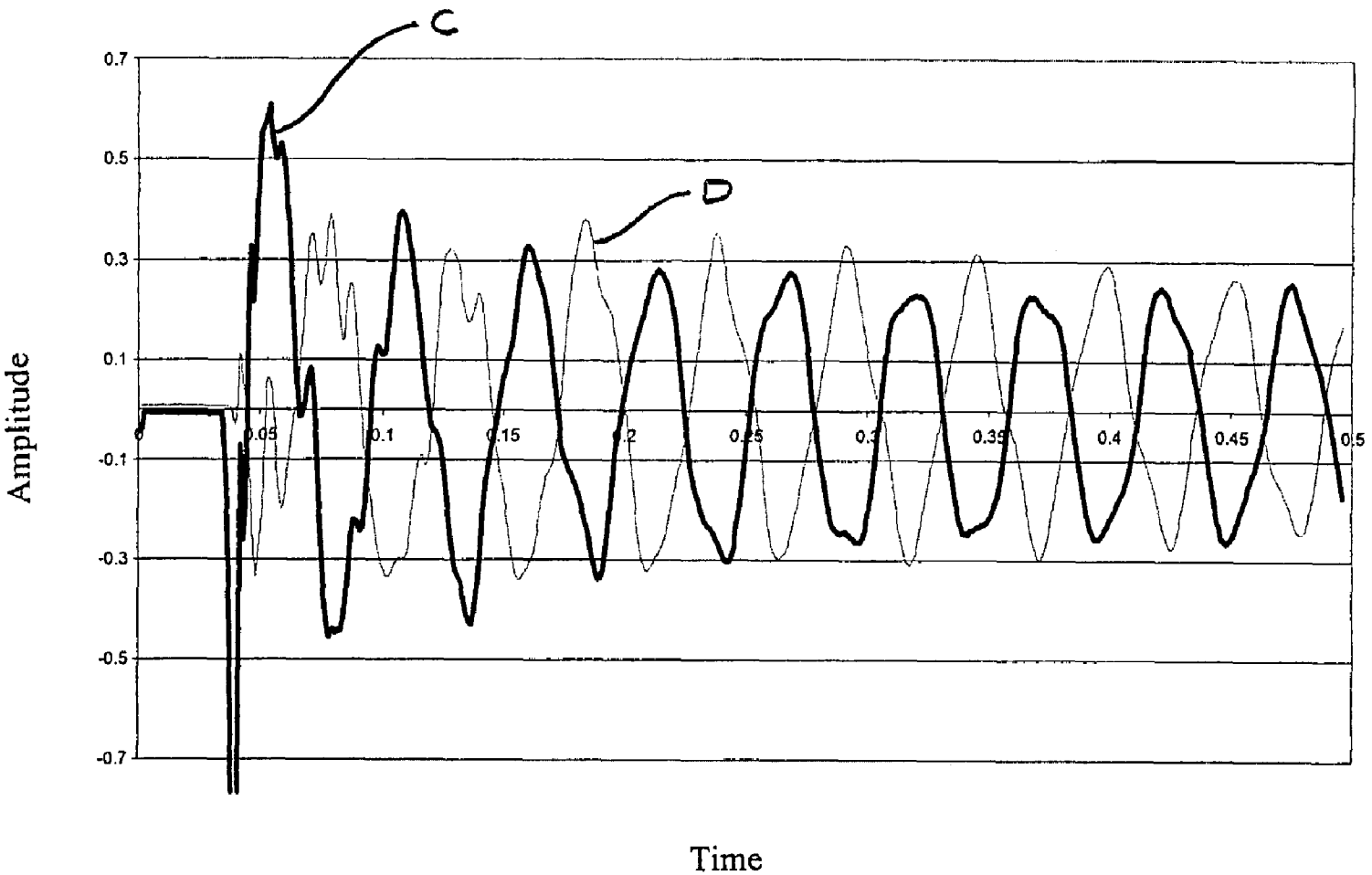
FIG. 9 is a graph showing the relative displacements of the first and second opposed hammers over time for the crushing device shown in FIGS. 4–7 when one of the two opposed hammers and its supporting beams is excited by a single induced initial displacement.

The out-of-phase vibration of the two crushing members 118, 128 is illustrated in FIGS. 8 and 9. The graph of FIG. 8 represents the oscillating displacement of the first crushing member 118 as solid line "A", and the cyclic displacement of the second crushing member 128 as dashed line "B". In FIG. 8, the cyclic displacements of the opposed crushing members 118, 28 are induced by simultaneously exciting or "ringing" both pairs of beam portions 112/113, 122/123. Energy and friction losses cause the amplitudes of beam vibration to gradually diminish over time. In operation, the exciters 132, 134 are periodically actuated to maintain the amplitudes of vibration at desired levels. FIG. 9 represents the out-of phase cyclic displacements of the crushing members 118, 128 when only one pair of beam portions (i.e. 112/113 or 122/123) is initially excited. The displacement of the first crushing member 118 over time is represented by line "C", and the displacement of the second crushing member 128 is represented by line "D". Because the beam portions are harmonically coupled like the prongs of a tuning fork, the second pair of beam portions responds in matching resonant vibration even without direct excitation to that pair of beam portions. Accordingly, the device 100 is self-governing for phase relationships, and synchronization between displacements of the opposed crushing members 118, 128 is achieved without external synchronization or control systems or mechanisms.

Like the embodiment 10 described above, the crushing apparatus 100 also is highly energy efficient compared to common compressive rock crushing equipment. During operation, the device 100 stores energy in its spring-mass systems. The device 100 translates this stored energy into inertia of the crushing members, which acts to crush the rock. Accordingly, the device 100 introduces substantial impact energy into rock with little energy loss. Such an impact crushing process is believed to consume much less energy than common compressive crushing processes. In addition, the high frequencies and high amplitudes that can be achieved by the device 100 permit the device 100 to be used to fracture both large and small rocks.

A crushing device according to the invention may be configured to operate at substantially any desired frequency of vibration by varying the stiffness and/or mass of the resonant spring-mass system. Higher frequencies will yield a smaller product more effectively than lower frequencies. A system according to the invention is believed to operate particularly effectively at modal frequencies that are less than or equal to about 100 Hz. Operating frequencies in a range from about 10 Hz. to about 40 Hz. are believed to be particularly effective for crushing rock. Much higher frequencies may be used for other products and other product size requirements.

The above descriptions of various embodiments of the invention are intended to illustrate various multiple aspects of the invention, and are not intended to limit the scope of the invention thereto. Persons of ordinary skill in the art will recognize that various modifications may be made to the described embodiments without departing from the invention. For example, though the described embodiments include two opposed movable crushing members for crushing objects such as rocks, another embodiment of the invention may include a first cantilevered crushing member that is movable, and an opposed second crushing member that is substantially stationary. In addition, an embodiment of the invention may include a plurality of pairs of crushing members and springs acting in concert. All such modifications are intended to be within the scope of the appended claims.

What is claimed is:

1. An apparatus for crushing a material, the apparatus comprising:

(a) a first beam having a first fixed end and a first substantially free end;

(b) a second beam having a second fixed end and a second substantially free end;

(c) a first crushing member on the first substantially free end of the first beam;

(d) a second crushing member on the second substantially free end of the second beam, the second crushing member being in opposed spaced relation with the first crushing member; and (e) at least one exciter configured to excite the first beam and the second beam in a substantially common plane in a cantilever beam mode of vibration at about a common modal frequency of the first and second beams, thereby causing the first and second crushing members to reciprocally converge and diverge.

2. An apparatus according to claim 1 wherein the first fixed end and the second fixed end are harmonically coupled to each other.

3. An apparatus according to claim 1 wherein the first fixed end and the second fixed end are affixed together.

4. An apparatus according to claim 1 wherein the first modal frequency is from about 1 Hz. to about 600 Hz.

5. An apparatus according to claim 4 wherein the first modal frequency is from about 10 Hz. to about 40 Hz.

6. An apparatus according to claim 1 wherein the first beam and second beam are first and second opposed portions of an arcuately shaped beam, wherein the first and second fixed ends adjoin one another proximate to a midpoint of the arcuately shaped beam.

7. An apparatus according to claim 1 further comprising a material feeder for introducing material to be crushed between the first and second crushing members.

8. A method of crushing a substantially solid material, the method comprising:

(a) providing a first spring-mass system comprising a first spring and a first crushing mass, the first spring-mass system having a first modal frequency of vibration and a first vibration node;

(b) providing a second spring-mass system comprising a second spring and a second crushing mass, wherein the second spring-mass system has a second modal frequency that is substantially equal to the first modal frequency of the first spring-mass system, and wherein the second spring-mass systems has a second vibration node that is substantially coincident with the first vibration node, the second spring-mass system being harmonically coupled to the first spring-mass system;

(c) exciting at least one of the first and second spring-mass systems such that the first and second spring mass systems are caused to vibrate about 180 degrees out of phase with each other at about the first modal frequency, thereby causing the first and second crushing masses to reciprocally converge and diverge; and (d) introducing a solid material between the reciprocally converging and diverging first and second crushing masses, thereby causing at least a portion of the solid material to be at least partially fragmented therebetween.

9. The method of claim 8 wherein the first spring is a first cantilevered beam having a first fixed end and a first free end, and the first crushing mass is attached to the first beam on or about the first free end.

10. The method of claim 9 wherein the second spring is a second cantilevered beam having a second fixed end and a second free end, and the second crushing mass is attached to the second beam on or about the second free end.

11. The method of claim 10 wherein the first and second fixed ends are affixed together.

12. The method of claim 8 wherein the first modal frequency is less than or equal to about 600 Hz.

13. The method of claim 8 wherein the first modal frequency is from about 10 Hz. to about 40 Hz.

14. The method of claim 8 wherein the solid material is rock.

15. An apparatus for fragmenting a substantially brittle material, the apparatus comprising:

(a) a first cantilevered beam having a first fixed end and a first free end;

(b) a first crushing head on the first beam proximate to the first free end;

(c) a second crushing head; and (d) means for exciting the first cantilevered beam at about a first modal frequency of the first cantilevered beam, wherein when so excited, the first crushing head reciprocally converges toward and diverges away from the second crushing head;

(e) whereby a brittle material positioned between the first and second crushing heads is at least partially fragmented.

16. An apparatus according to claim 15 wherein the second crushing head is substantially stationary.

17. An apparatus according to claim 15 further comprising a second cantilevered beam having a second fixed end and a second free end, wherein the second crushing head is on the second beam proximate to the second free end.

18. An apparatus according to claim 17 wherein the means for exciting the first cantilevered beam also excites the second cantilevered beam at about a second modal frequency of the second cantilevered beam, wherein when so excited, the second crushing head reciprocally converges toward and diverges away from the first crushing head, and whereby the first and second beams and first and second crushing heads vibrate about 180 degrees out of phase with each other.

19. An apparatus according to claim 15 wherein the means for exciting comprises a piston driven actuator.

20. An apparatus according to claim 15 wherein the means for exciting comprises a solenoid or a linear motor.

21. An apparatus according to claim 15 wherein the means for exciting comprises a mechanical actuator.

22. A crushing apparatus comprising:

(a) a substantially U-shaped spring member having a first beam portion having a first free end, a second beam portion having a second free end, and a fixed center portion, the first and second free ends being in opposed, spaced relation;

(b) a first crushing mass on the first free end;

(c) a second crushing mass on the second free end; and (d) an exciter configured to excite the first and second beam portions at about a common first modal frequency, wherein when so excited, the first and second crushing masses reciprocally converge toward and diverge away from each other.

23. A crushing apparatus according to claim 22 wherein the first modal frequency is between about 1 Hz. and about 600 Hz.

24. A crushing apparatus according to claim 22 wherein the exciter comprises a piston driven device.

25. A crushing apparatus according to claim 22 wherein the exciter comprises a solenoid or linear motor.

26. A rock crushing apparatus comprising:

(a) a substantially U-shaped first spring member including a first elongated beam portion having a first free end, a second elongated beam portion having a second end free end, and a first yoke portion, wherein the first spring member has a first modal frequency, and wherein the first yoke portion is fixed to a substantially rigid foundation;

(b) a substantially U-shaped second spring member including a third elongated beam portion having a third free end, a fourth elongated beam portion having a fourth free end, and a second yoke portion, wherein the second spring member has a first modal frequency that is substantially equal to the first modal frequency of the first spring member; and wherein the second yoke portion is fixed to the foundation;

(c) a first crushing member disposed between the first free end of the first spring member and the third free end of the second spring member;

(d) a second crushing member disposed between the first free end of the first spring member and the third free end of the second spring member;

(e) an exciter configured to excite the first and second spring members at or near the first modal frequency, thereby causing the first and second crushing members to harmonically converge and diverge.

27. A rock crushing apparatus according to claim 26 wherein the first crushing member includes a first inclined crushing surface, and wherein the second crushing member includes a second inclined crushing surface.

28. A rock crushing apparatus according to claim 26 wherein the exciter comprises:

(a) a first exciter disposed substantially between the first and second free ends of the first spring member; and (b) a second exciter disposed substantially between the third and fourth free ends of the second spring member.

29. A rock crushing apparatus according to claim 26 and further comprising at least one containment baffle at least partially surrounding the first and second crushing members, whereby loose materials introduced between the first and second crushing members are substantially contained therebetween.

* * * * *